United States Patent [19]

Wülfing et al.

[11] 4,355,749

[45] Oct. 26, 1982

[54] FEEDING APPARATUS FOR WET YARN

[75] Inventors: Karl-Heinz Wülfing; Werner Engelhardt, both of Wuppertal, Fed. Rep. of Germany

[73] Assignee: Hacoba Textilmaschinen GmbH & Co. KG, Wuppertal, Fed. Rep. of Germany

[21] Appl. No.: 192,822

[22] Filed: Oct. 1, 1980

[30] Foreign Application Priority Data

Oct. 2, 1979 [DE] Fed. Rep. of Germany ..... 2939873

[51] Int. Cl.[3] ..... B65H 51/00; B65H 51/14

[52] U.S. Cl. ..... 226/171; 28/282; 57/90; 226/190

[58] Field of Search ..... 226/171, 172, 170, 190; 57/90; 28/282; 65/2, 3 R, 11 R, 11 W, 9; 66/132 R, 132 T

[56] References Cited

U.S. PATENT DOCUMENTS

| | | | |
|---|---|---|---|
| 2,685,362 | 8/1954 | Larsen | 226/171 X |
| 2,685,763 | 8/1954 | Courtney et al. | 226/170 X |
| 3,444,682 | 5/1969 | Polacco et al. | 28/282 X |
| 3,802,228 | 4/1974 | Deniega | 242/47.01 X |
| 3,831,830 | 8/1974 | Venot | 226/171 |
| 4,010,883 | 3/1977 | Ritter | 226/171 |
| 4,208,000 | 6/1980 | Drummond | 226/171 |

*Primary Examiner*—Stanley N. Gilreath
*Attorney, Agent, or Firm*—Karl F. Ross

[57] ABSTRACT

A filament-feeding apparatus for a wet freshly dyed yarn has a feed wheel centered on and rotatable about an axis and having a pair of side parts having generally circular peripheries lying in parallel spaced-apart planes perpendicular to this axis, and a plurality of angularly spaced center parts axially bridging the side parts and having outer edges axially aligned with the peripheries. The wheel is open and free of structure in zones radially inward of the peripheries and radially outward of secants extending between the outer edges. A flexible endless belt having a width equal at least to the axial spacing between the peripheries is held by a plurality of pulleys in a circular arc radially against these peripheries so that the belt forms upstream and downstream nips at the ends of the circular arc. A filament is fed under tension tangentially of the wheel to the upstream nip between the side parts of the wheel and is withdrawn under tension and tangentially of the wheel from the downstream nip between the side parts. The filament is thus stretched over the outer edges into a succession of straight-line secants along the engagement arc and only engages the belt at the outer edges along this arc.

10 Claims, 6 Drawing Figures

FEEDING APPARATUS FOR WET YARN

FIELD OF THE INVENTION

The present invention relates to a filament-feeding apparatus. More particularly this invention concerns such an apparatus used to longitudinally advance a wet filament, such as one that has been dyed.

BACKGROUND OF THE INVENTION

A standard high-speed filament-feeding apparatus comprises a wheel having a normally cylindrical periphery and a flexible belt a portion of which is urged in a circular arc radially against the periphery of the wheel. The filament to be advanced runs between the wheel and a stretch of belt engaged against it, so that it is held along this entire arc. High-speed rotation of the wheel, with the belt advance speed being exactly equal to the peripheral speed of the wheel, therefore rapidly advances the filament. Such systems can be used to advance one or more filaments and are generally considered the best modes of feeding a filament at high speed between two locations.

Such systems have the considerable disadvantage that they cannot readily be employed with a wet filament. In particular a so-called space-dyed yarn can be ruined by such a feeding apparatus. The feed apparatus squeezes the space-dyed yarn so that some of the dye will be driven out of it and, furthermore, dye of one color from one part of the yarn will be carried over to other parts of the yarn dyed another color. Furthermore even in wet yarns having all the same color or saturated with the same liquid from one end to another, such a feed wheel normally makes a considerable mess with the liquid it drives from the yarn, saturating the wheel and adjacent equipment in a very short time.

OBJECTS OF THE INVENTION

It is therefore an object of the present invention to provide an improved filament-feeding apparatus.

Another object is the provision of such an apparatus which can be used with wet yarns, particularly of the space-dyed type, but which will not have the above-given disadvantages.

SUMMARY OF THE INVENTION

These objects are attained according to the instant invention by use of a feed wheel which has a pair of side parts having generally circular peripheries lying in parallel spaced-apart planes perpendicular to the axis and a plurality of angularly spaced center parts axially bridging these side parts and having outer edges axially aligned with the peripheries. The wheel is open and free of structure in zones radially inward of the imaginary cylinder formed by the peripheries and radially outward of secantal planes extending between the inner edges and parallel to the rotation axis of the feed wheel. The flexible endless belt has a width equal at least to the axial spacing between these peripheries and is so constituted that it will follow a circular arc when urged by guide means radially against the peripheries. The filament is fed under tension and tangentially of the wheel to one of the nips formed between the belt and the wheel and is withdrawn under tension and tangentially of the wheel from the other of these nips. The filament, however, is fed in between the side parts so that it is stretched over the outer edges into a succession of straight-line secants along the arc and only engages the belt at the outer edges. Thus contact between the filament on one side and the belt and the wheel on the other side is minimized, contact only being made at the location where the filament is pinched between the outer edges of the center parts and the belt.

Such a system works as well as the prior-art systems, treating the yarn relatively gently while at the same time being able to advance it at extremely high speed. Nonetheless the limited amount of squeezing of the yarn at the outer edges of the center parts ensures that even a multicolor space-dyed yarn can be advanced with such an apparatus without spreading a noticeable amount of dye from one section of the yarn to another differently colored section. As a result of what virtually amounts to point contact between the wet yarn and the feed wheel and belt very little liquid is picked up by the feed wheel and belt so that the system is hardly messy at all. In fact whatever small quantities of liquid might be picked up by the outer edges of the center parts are normally thrown centrifugally off by the wheel which may be rotating at a peripheral speed of 1500 m/min.

According to this invention the entire feed wheel is formed integrally, as a single metallic piece, with radially extending webs constituting the center parts. Such a structure is extremely rugged so that it can easily withstand the considerable centrifugal forces of high-speed rotation.

According to another feature of this invention variations in advance speed for the yarn are largely avoided by forming the peripheries of the side parts of the wheel with axially aligned teeth and by forming the belt with complementary teeth. The outer edges of the center parts are axially aligned with respective teeth of the peripheries so that an intertooth groove or notch in the belt will fit over each outer edge as the wheel rotates and effectively clamp the yarn to it. In order to prevent buildup of liquid on the belt the number of teeth of the belt is not a whole-number multiple of the number of teeth of the peripheries, so that on each full revolution of the belt different intertooth grooves will be engaged by the outer edges of the center parts.

The feed wheel is also provided according to this invention with damping pins which axially bridge the side parts and which alternate with the center parts, each being positioned radially inward of a secantal plane tangenting the outer edges of the respective flanking central parts. Thus a filament spanned tightly over two outer edges will at most just touch the respective damping pin so that any vibration in this filament will be stopped. Since the force with which the yarn will engage radially inwardly on the damping pin is extremely low, no liquid will be driven out of the yarn by this structure.

It is also possible according to this invention to provide a yarn-breakage-detecting apparatus downstream of the downstream nip formed between the belt and the wheel. This thread-breakage monitor can simply be a funnel attached to a suction apparatus so that if the yarn breaks it will be thrown centrifugally toward the funnel and a photocell in it will respond by shutting down the drive means for the wheel. Another such photocell may be provided to detect whether a filament is still engaged between the side parts at a location downstream of the downstream nip and upstream of the upstream nip, that is beyond the arc where the belt contacts the wheel.

In order to ensure rapid response a combined clutch and brake of the electromagnetic type is provided between the drive motor and the feed wheel. Actuation of this clutch/brake by the breakage-detection means will immediately arrest the feed wheel and prevent yarn from being wasted or wound up on the feed wheel. Such a system can ideally be combined with a single drive motor for a plurality of such feed wheels, with each feed wheel connected via the respective brake/-clutch and a transmission to the drive motor and to a respective flywheel. Such a system is particularly advantageous when a battery of such feeding apparatuses is provided, as is common in textile plants.

SPECIFIC DESCRIPTION

Figure 1:
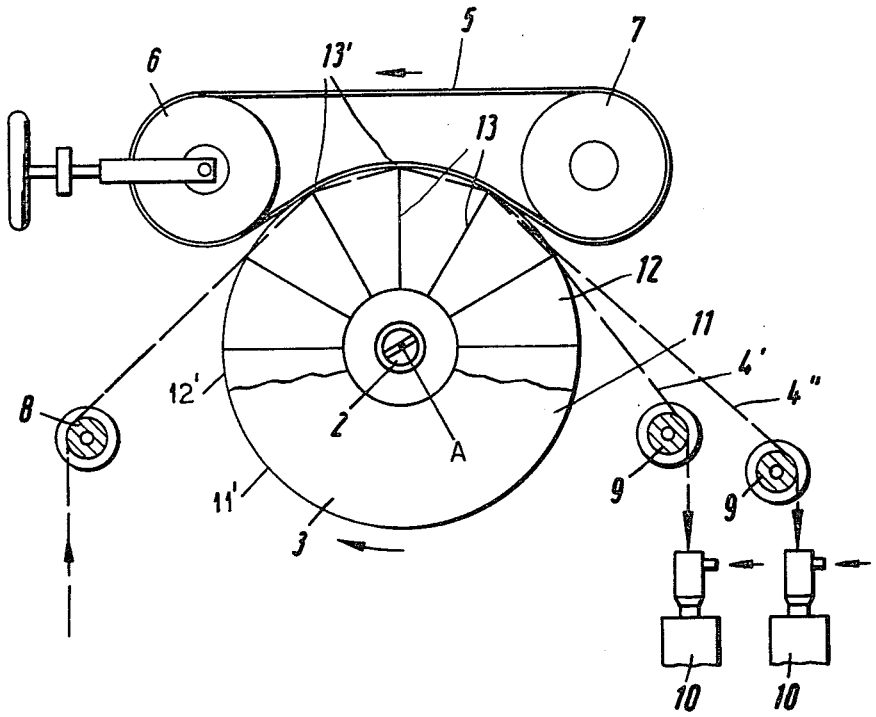
FIG. 1 is a side partly schematic view of a system according to the instant invention.
Figure 2:
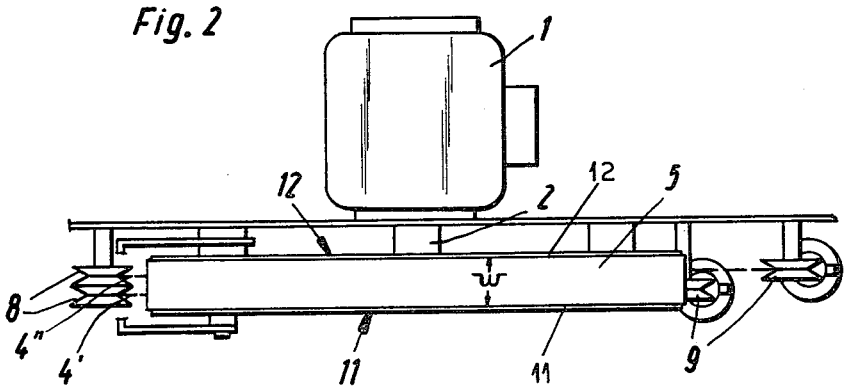
FIG. 2 is a top view of the system of FIG. 1.

As shown in FIGS. 1 and 2 a feed apparatus according to this invention has an electric variable-speed drive motor 1 having an output shaft 2 connected to a drive wheel 3 serving to advance a pair of wet dyed yarns 4' and 4" extending parallel to each other in respective parallel planes perpendicular to the axis A of the shaft 2. A so-called press belt 5 having an axial width W is spanned over a displaceable tensioning roller or pulley 6 and a fixed roller or pulley 7.

The filaments 4' and 4" are fed in through respective coaxial input wheels or rollers 8 and out through respective rollers or wheels 9 to respective fixing devices 10. The filaments 4' and 4" are space-dyed and wet with dye when they contact the wheel 3.

According to this invention the wheel 3 is formed by a pair of side parts or disks 11 and 12 having circular outer peripheries 11' and 12' centered on the axes A. Radially extending webs 13 angularly spaced at 30° have outer edges 13' parallel to the axis A and spaced radially from this axis A by the same distance as the peripheries 11' and 12'.

Thus with the system of FIGS. 1 and 2 the two yarns will only be engaged between the flat belt 5 and the outer edges 13', over an arc of approximately 90°. The belt follows a circular pattern, as it engages the circular peripheries 11' and 12', but the yarns 4' and 4" follow a path having a plurality of straight-line sections each corresponding to a secant drawn between the outer edges 13'. Contact between the belt 5 and wheel 3 on one side and the filaments 4' and 4" on the other is therefore minimized, while high-speed advance of the filaments 4' and 4" is possible.

Figure 3:
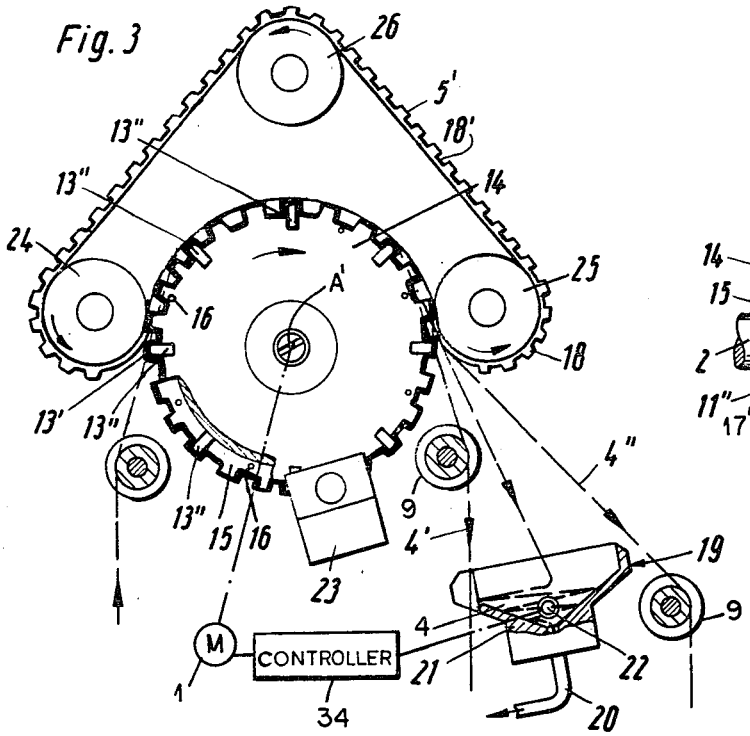
FIG. 3 is a side partly schematic and sectional view of another system according to this invention.

FIG. 3 shows a substantially identical arrangement, but wherein a wheel 14 is employed having a pair of side parts 11" and 12" having outer peripheries formed with teeth 17 separated by spaces 17'. The two side parts 11" and 12" form an outwardly open groove 15 that is bridged by center parts 13" functionally identical to the parts 13 of FIG. 1, that is bridging the side plates 11" and 12" and acting as filament supports. Each of these parts 13", however, is aligned with teeth 17 of the peripheries. In addition alternating with the center parts 13" are damping pins 16 which extend axially between the side parts 11" and 12" and which lie immediately inside secantal planes drawn between the outer edges of the parts 13".

A belt 5' is here formed with teeth 18 separated by grooves or spaces 18' of the same pitch or intertooth spacing as the teeth 17 and notches or grooves 17' of the peripheries of the wheel side parts 11" and 12". This belt 5' is spanned over two pulleys or rollers 24 and 25 which approximately diametrically flank the wheel 14 and over a third roller 26 which can be displaced radially relative to the axis A' of the wheel 14, so as to tension the belt 5'. The number of teeth 18 is not equal to or a whole-number multiple of the number of teeth 17 so that as the belt 5' revolves different intertooth spacings 18' mesh with the center parts 13".

Thus with the system according to the instant invention the filaments 4' and 4" will be effectively pinched at the location where each of the outer edges of the center parts 13" fits into an intertooth notch 18' of the belt 5'. Furthermore the use of a toothed belt 5' eliminates any possibility of slippage between the belt 5' and wheel 14 so that an accurate advance speed is obtained. Any vibrations in the stretches of the filaments 4' and 4" stretched between the center parts 13" will be effectively damped by means of the pins 16 which prevent inward deflection of the yarns 4' and 4" due to vibration beyond a secantal plane as described above. More particularly, a piece of a filament stretched between the outer edges of two parts 13" will engage the respective pin 16 if it vibrates or otherwise moves laterally, so that such vibration will effectively be checked.

Figure 4:
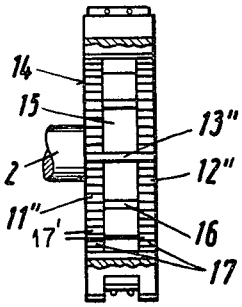
FIG. 4 is a side view of a feed wheel of the system of FIG. 3.

The system according to the instant invention as seen in FIGS. 3 and 4 is also provided with a yarn-breakage detector 19 comprising a funnel 21 connected to a suction line 20 and provided with a photocell 22 connected via appropriate control means 34 to the motor 1. This funnel 21 is provided at a location in tangential line with the downstream nip formed between the belt 5' and wheel 14 so that if a yarn breaks it will be cast into this funnel 21, aided by the suction in its base caused by the line 20, to interrupt the beam of light directed on the photocell 22. The controller 34 will then shut down the motor 1.

Figure 5:
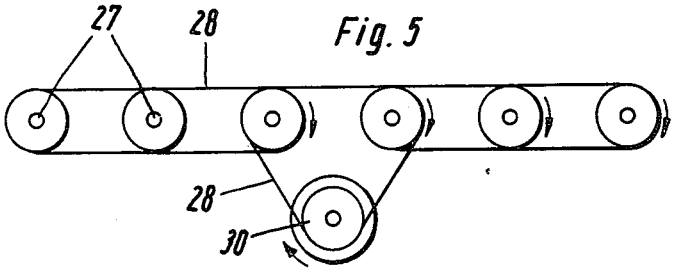
FIG. 5 is an end view of a drive system according to this invention.
Figure 6:
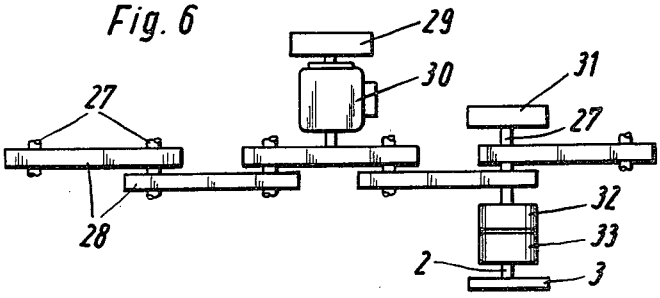
FIG. 6 is a top view of the drive system of FIG. 5.

It is also possible according to this invention to mount a plurality of wheels 3 or 14 as shown in FIGS. 5 and 6 on respective parallel but spaced-apart shafts 27 interconnected by means of toothed belts 28 one of which is driven by a motor 30 carrying at its opposite end a flywheel 29. In addition each shaft 27 may carry a respective flywheel 31 and is connected via a respective clutch 32 and brake 33 to the shaft 2 of the respective feed wheel 3. When yarn breakage is detected either by the apparatus 19 or the apparatus 23 the clutch 32 is opened and brake 33 is closed to automatically arrest the wheel 3. The flywheels 29 and 31 ensure constant and uniform rotation speed.

A second thread-breakage monitor 23 is provided downstream of the downstream nip formed between the belt 5' and wheel 14 and upstream of the upstream nip thereof. This arrangement comprises a photocell at which a beam of light is directed so that if a yarn 4' or 4" breaks and starts to wind around on the wheel 14 the detector 23 will be able to generate an output that, like the output of the detector 19, will shut down the feed.

With the system according to the instant invention it is therefore possible to advance a relatively wet freshly dyed yarn at high speed without squeezing much of the dye out of the yarn, yet while still obtaining a high advance speed. The system will not be messy at all since there is virtually only point contact between the yarns and the feed structure. What little liquid is transferred to the wheel and belt will be thrown centrifugally off.

We claim:

1. A filament-feeding apparatus comprising:

a feed wheel centered on and rotatable about an axis and having a pair of side parts having generally circular peripheries lying in parallel spaced-apart planes perpendicular to said axis and a plurality of angularly spaced center parts axially bridging said side parts and having outer edges axially aligned with said peripheries, said wheel being open and free of structure in zones radially inward of said peripheries and radially outward of secants extending between said outer edges;

a flexible endless belt having a width equal at least to the axial spacing between said peripheries;

guide means including a plurality of pulleys carrying said belt for holding a portion of said belt in a circular arc radially against said peripheries, whereby said belt forms nips at the ends of said circular arc;

means for feeding a filament under tension and tangentially of said wheel to one of said nips between said side parts and for withdrawing said filament under tension and tangentially of said wheel from the other of said nips between said side parts, whereby said filament is stretched over said outer edges into a succession of straight-line secants along said arc and only engages said belt at said outer edges along said arc; and drive means for rotating said wheel about said axis and thereby advancing said filament.

2. The apparatus defined in claim 1 wherein said parts of said wheel are integral, said center parts being radially extending webs interconnecting said side parts.

3. The apparatus defined in claim 1, further comprising respective damping pins alternating with said center parts and extending axially between said side parts and each lying immediately radially inside a secantal plane extending axially and angularly between the outer edges of the respective flanking center parts, whereby a filament engaged secantally over two of said outer edges will at most lightly touch the pin between them.

4. The apparatus defined in claim 1 wherein said peripheries are formed with teeth and said belt is correspondingly toothed.

5. The apparatus defined in claim 4 wherein said edges are each axially aligned with a tooth of the respective periphery.

6. The apparatus defined in claim 4 wherein the number of teeth of said belt differs from a whole-number multiple of the number of teeth of said peripheries.

7. The apparatus defined in claim 1 wherein said guide means includes three such pulleys, two diametrically flanking said feed wheel at said nips and one spaced angularly along said arc between said nips and radially spaced outwardly from said peripheries.

8. The apparatus defined in claim 1, further comprising means for detecting filament breakage downstream of said other nip and for arresting said feed wheel via said drive means on detection of filament breakage.

9. The apparatus defined in claim 8 wherein said drive means includes a drive motor having an output shaft, and a combined clutch-brake between said shaft and said wheel.

10. The apparatus defined in claim 8 wherein said drive means includes a plurality of such clutch-brakes each connected to a respective one of a plurality of such feed wheels, and a flywheel connected to each feed wheel via the respective clutch-brake.

* * * * *